US010608380B2

(12) United States Patent
Li et al.

(10) Patent No.: US 10,608,380 B2
(45) Date of Patent: Mar. 31, 2020

(54) CONNECTOR

(71) Applicant: Tyco Electronics (Shanghai) Co. Ltd., Shanghai (CN)

(72) Inventors: Cui Li, Shanghai (CN); Hao Wang, Shanghai (CN); Jianfei Yu, Shanghai (CN); Biao Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/032,225

(22) Filed: Jul. 11, 2018

(65) Prior Publication Data

US 2019/0020153 A1 Jan. 17, 2019

(30) Foreign Application Priority Data

Jul. 11, 2017 (CN) ..... 2017 2 0834853 U

(51) Int. Cl.

| | |
|---|---|
| ***H01R 13/648*** | (2006.01) |
| ***H01R 13/6581*** | (2011.01) |
| ***H01R 9/03*** | (2006.01) |
| ***H01R 13/622*** | (2006.01) |
| ***H01R 13/6592*** | (2011.01) |

(52) U.S. Cl.

CPC ..... *H01R 13/6581* (2013.01); *H01R 9/032* (2013.01); *H01R 13/622* (2013.01); *H01R 13/6592* (2013.01)

(58) Field of Classification Search

CPC .. H01R 13/6581; H01R 13/622; H01R 9/032; H01R 13/562; H04B 15/025; A22C 13/02

USPC ..... 439/607.01

See application file for complete search history.

(56) References Cited

U.S. PATENT DOCUMENTS

| | | | | |
|---|---|---|---|---|
| 2,969,420 A * | 1/1961 | Blackington | ..... | H04B 15/025 174/75 R |
| 3,639,130 A * | 2/1972 | Eichin | ..... | A22C 13/02 138/118.1 |
| 3,819,849 A * | 6/1974 | Baker | ..... | H01R 13/562 174/86 |

* cited by examiner

*Primary Examiner* — Jean F Duverne
(74) *Attorney, Agent, or Firm* — Barley Snyder

(57) ABSTRACT

A connector comprises a metal housing, an insulation body received in the metal housing, a contact disposed in the insulation body, a cable inserted into the metal housing and electrically connected to the contact, and a metal sleeve disposed in the metal housing and electrically contacting the metal housing. A plurality of braided shielding wires of the cable are turned back onto an outer sheath of the cable. The metal sleeve is sleeved on the plurality of braided shielding wires and presses the plurality of braided shielding wires on the outer sheath of the cable.

20 Claims, 4 Drawing Sheets

CONNECTOR

CROSS-REFERENCE TO RELATED APPLICATION

This application claims the benefit of the filing date under 35 U.S.C. § 119(a)-(d) of Chinese Patent Application No. 201720834853.4, filed on Jul. 11, 2017.

FIELD OF THE INVENTION

The present invention relates to an electrical connector and, more particularly, to a round electrical connector.

BACKGROUND

A round electrical connector for an instrument, a control equipment, or an electrical equipment generally comprises a metal housing, an insulation body received in the metal housing, a contact provided in the insulation body, and a cable electrically connected to the contact. The cable is inserted into the metal housing from one end of the metal housing and electrically connects to the contact in the metal housing.

In order to ensure electromagnetic shielding of the connector, it is usually necessary to electrically connect braided shielding wires of the cable to the metal housing. The braided shielding wires of the cable are turned back onto an elastic seal ring provided on a plastic tail sleeve. When the elastic seal ring is compressed between the plastic tail sleeve and the metal housing, the braided shielding wires are pressed against an inner wall of the metal housing by the elastic seal ring, thereby realizing an electrical connection between the braided shield wires and the metal housing.

However, it is difficult to handle the braided shield wires of the cable. For example, it is necessary to use a cutting tool to cut off an extra length of braided shield wires, which is inconvenient and time-consuming. Moreover, the elastic seal ring is easily punctured or worn by the braided shielding wires, and it is laborious and difficult to reinstall the elastic seal ring after disassembly. In addition, the braided shielding wires do not create a good, reliable electromagnetic shielding effect for the connector.

SUMMARY

A connector comprises a metal housing, an insulation body received in the metal housing, a contact disposed in the insulation body, a cable inserted into the metal housing and electrically connected to the contact, and a metal sleeve disposed in the metal housing and electrically contacting the metal housing. A plurality of braided shielding wires of the cable are turned back onto an outer sheath of the cable. The metal sleeve is sleeved on the plurality of braided shielding wires and presses the plurality of braided shielding wires on the outer sheath of the cable.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
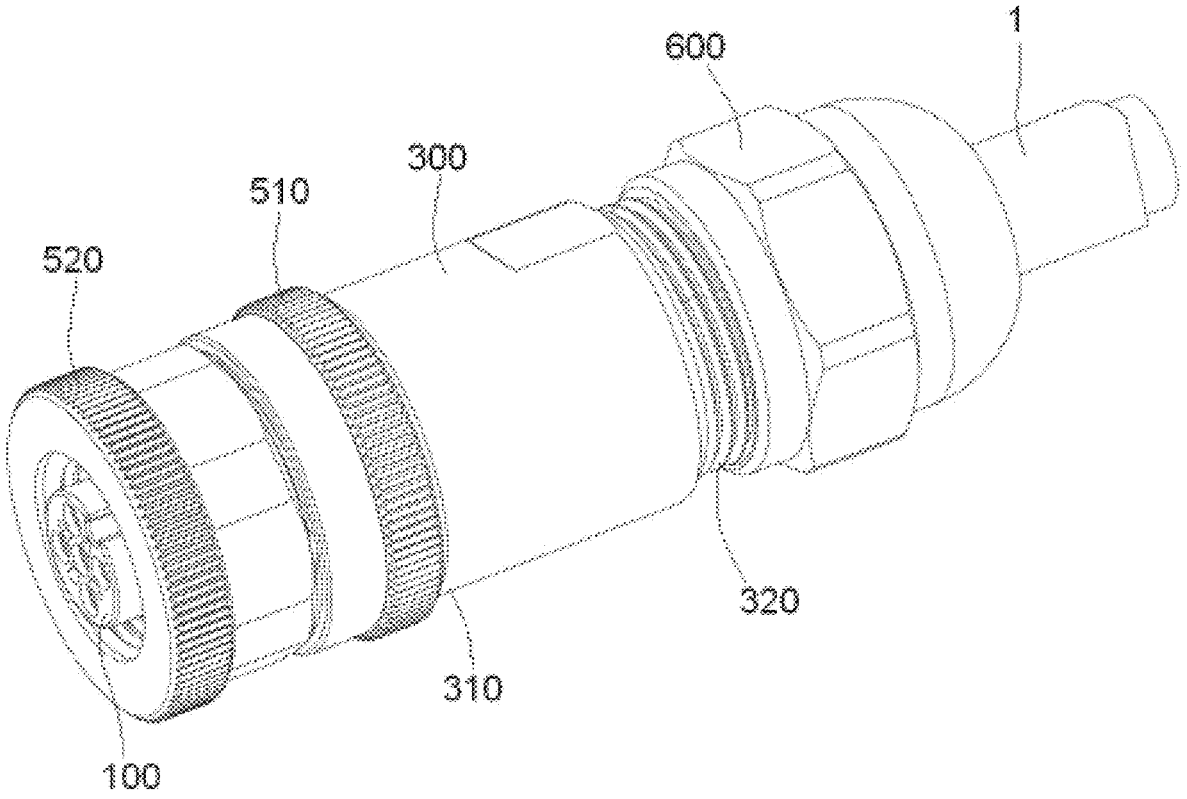
FIG. 1 is a perspective view of a connector according to an embodiment.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A connector according to an embodiment, as shown in FIGS. 1-4, comprises an insulation body 100, a contact 200, a metal housing 300, a metal sleeve 700, and a cable 1. The insulation body 100 is received in the metal housing 300. The contact 200 is provided in the insulation body 100. The cable 1 is inserted into the metal housing 300 and is electrically connected to the contact 200. The metal sleeve 700 is provided in the metal housing 300 and electrically contacts the metal housing 300. In the shown embodiment, the connector is configured to be a round connector with a cylindrical shape.

Figure 2:
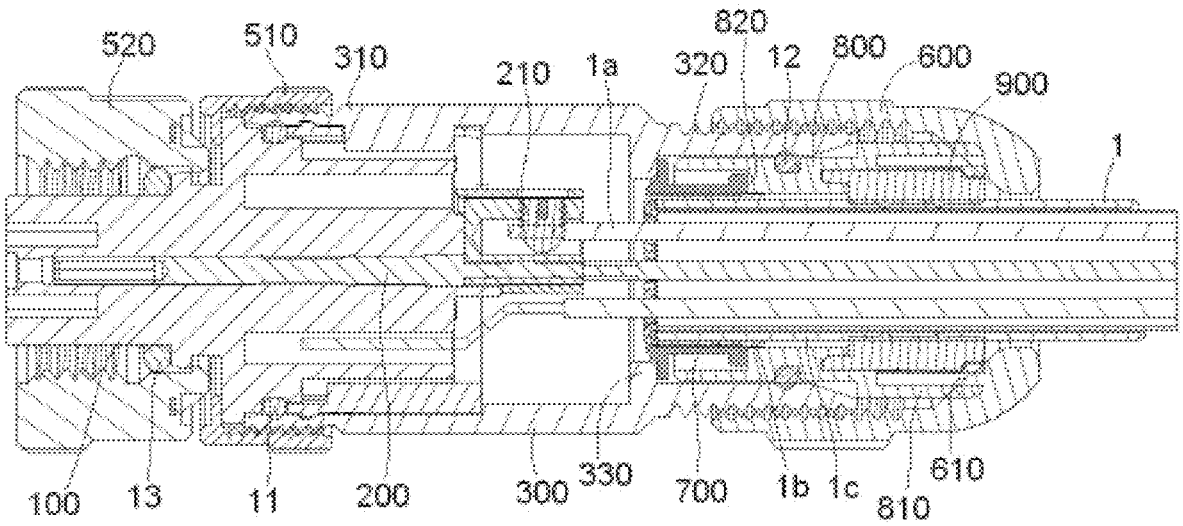
FIG. 2 is a sectional side view of the connector of FIG. 1.
Figure 3:
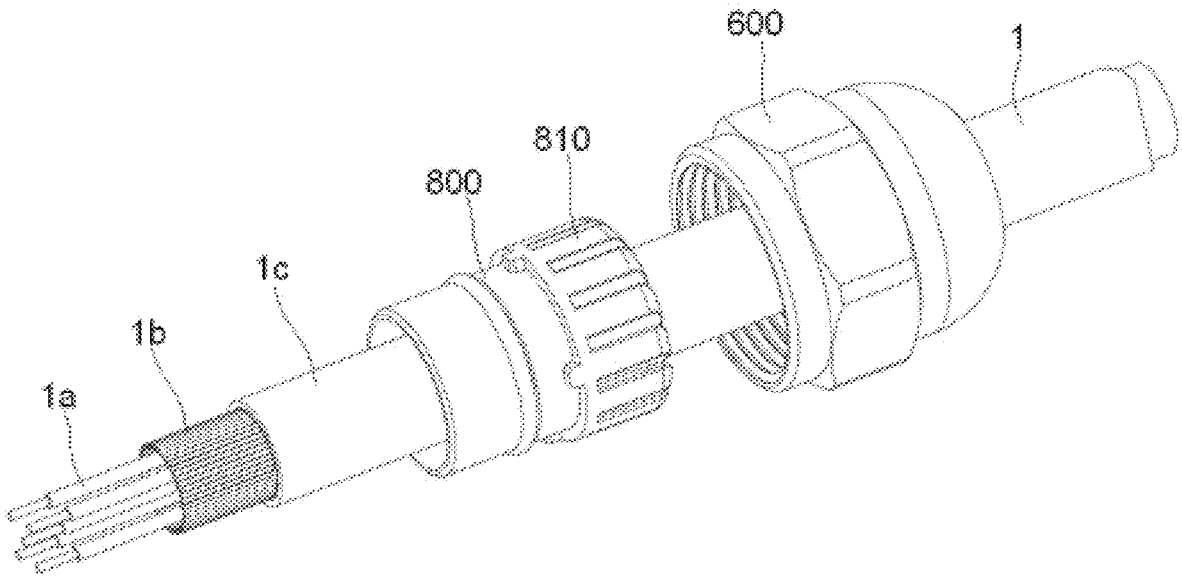
FIG. 3 is a perspective view of a cable extending through a plastic tail sleeve and a thread sleeve of the connector.
Figure 4:
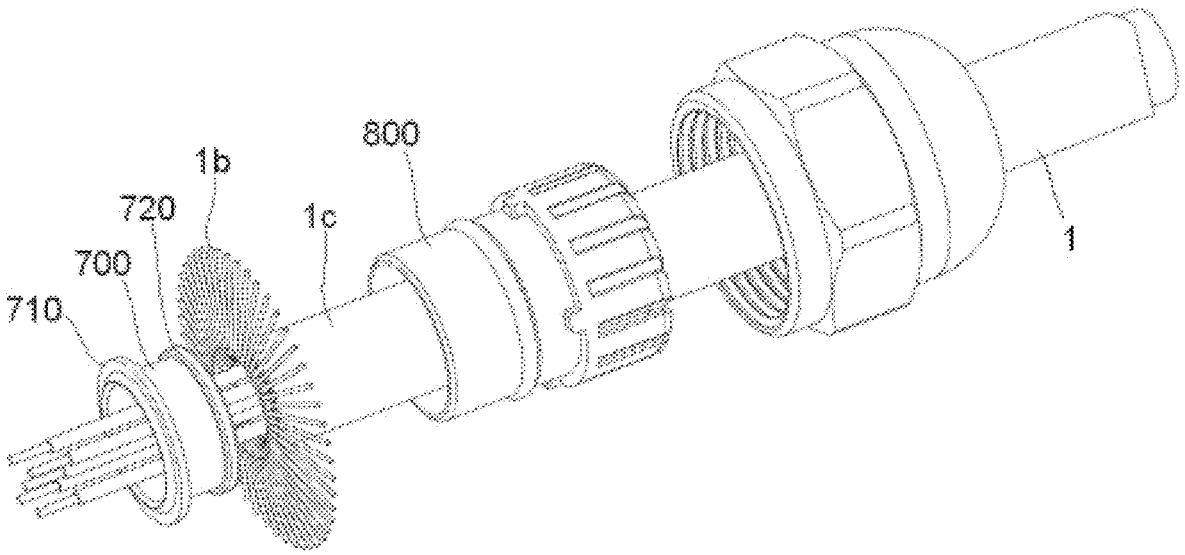
FIG. 4 is a perspective view of a metal sleeve of the connector mounted onto the cable.

As shown in FIGS. 2-4, exposed braided shielding wires 1*b* of the cable 1 are turned back onto an outer sheath 1*c* of the cable 1. The metal sleeve 700 is sleeved on the braided shielding wires 1*b* and presses the braided shielding wires 1*b* on the outer sheath 1*c* of the cable 1; the braided shielding wires 1*b* of the cable 1 are held on the outer sheath 1*c* of the cable 1 by the metal sleeve 700. The metal sleeve 700 is electrically connected to the metal housing 300. Thereby, the braided shielding wires 1*b* are electrically connected to the metal housing 300 by metal sleeve 700, which improves the electromagnetic shielding effect of the connector. It is further unnecessary to cut the extra length of braided shielding wires 1*b*, improving the connection efficiency of the braided shielding wires 1*b* and improving the electromagnetic shielding effect of the connector.

Figure 5:
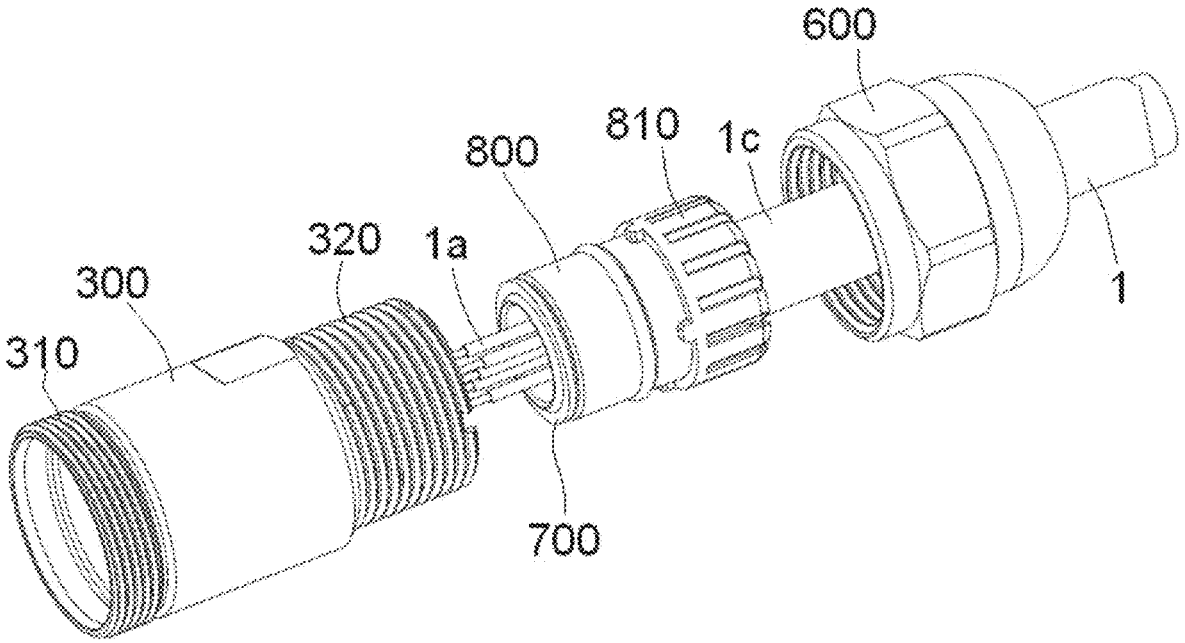
FIG. 5 is a perspective view of inserting the metal sleeve into the plastic tail sleeve and mounting a metal housing of the connector on the plastic tail sleeve.

The connector, as shown in FIGS. 2-5, comprises a plastic tail sleeve 800. The plastic tail sleeve 800 is sleeved on a rear portion of the metal sleeve 700 and mounted in a rear end 320 of the metal housing 300. Insertion of the metal sleeve 700 into the plastic tail sleeve 800 and mounting of the metal housing 300 onto the plastic tail sleeve 800 is shown in FIG. 5.

As shown in FIG. 2, a first positioning protrusion 820 extends circumferentially around an inner wall of the plastic tail sleeve 800. A second positioning protrusion 330 extends circumferentially around an inner wall of the metal housing 300. The metal sleeve 700 is pressed and positioned between the first positioning protrusion 820 and the second positioning protrusion 330, so that the metal sleeve 700 is brought into electrical contact with the metal housing 300. The first positioning protrusion 820 abuts against a rear end 720 of the metal sleeve 700 and the second positioning protrusion 330 abuts against a front end 710 of the metal sleeve 700, so that the front end 710 of the metal sleeve 700 electrically contacts the second positioning protrusion 330 of the metal housing 300.

The connector, as shown in FIGS. 1-3, 5, and 6, further comprises an elastic seal sleeve 900 and a thread sleeve 600. The elastic seal sleeve 900 is adapted to be sleeved on the cable 1. The thread sleeve 600 is adapted to be screwed onto the rear end 320 of the metal housing 300. The plastic tail sleeve 800 comprises a plurality of elastic claws 810 at a rear end thereof. The plurality of elastic claws 810 are arranged around the elastic seal sleeve 900. The thread sleeve 600 is configured to press the plurality of elastic claws 810 on the elastic seal sleeve 900, so as to press the elastic seal sleeve 900 on the cable 1 by the plurality of elastic claws 810.

The thread sleeve 600, as shown in FIG. 2, has a tapered inner wall surface 610 that is gradually narrowed toward a right end in FIG. 2. The tapered inner wall surface 610 is adapted to press the plurality of elastic claws 810 on the elastic seal sleeve 900, so as to press the elastic seal sleeve 900 on the cable 1.

As shown in FIGS. 2-5, in an embodiment, a first groove extend circumferentially around an outer wall of a main body of the plastic tail sleeve 800. A first seal ring 12 is received in the first groove and compressed between the plastic tail sleeve 800 and the metal housing 300, so as to seal an interface between the plastic tail sleeve 800 and the metal housing 300.

The insulation body 100, as shown in FIGS. 1 and 2, is received in a front end 310 of the metal housing 300. The cable 1 is adapted to be inserted into the connector from the rear end 320 of the metal housing 300.

Figure 6:
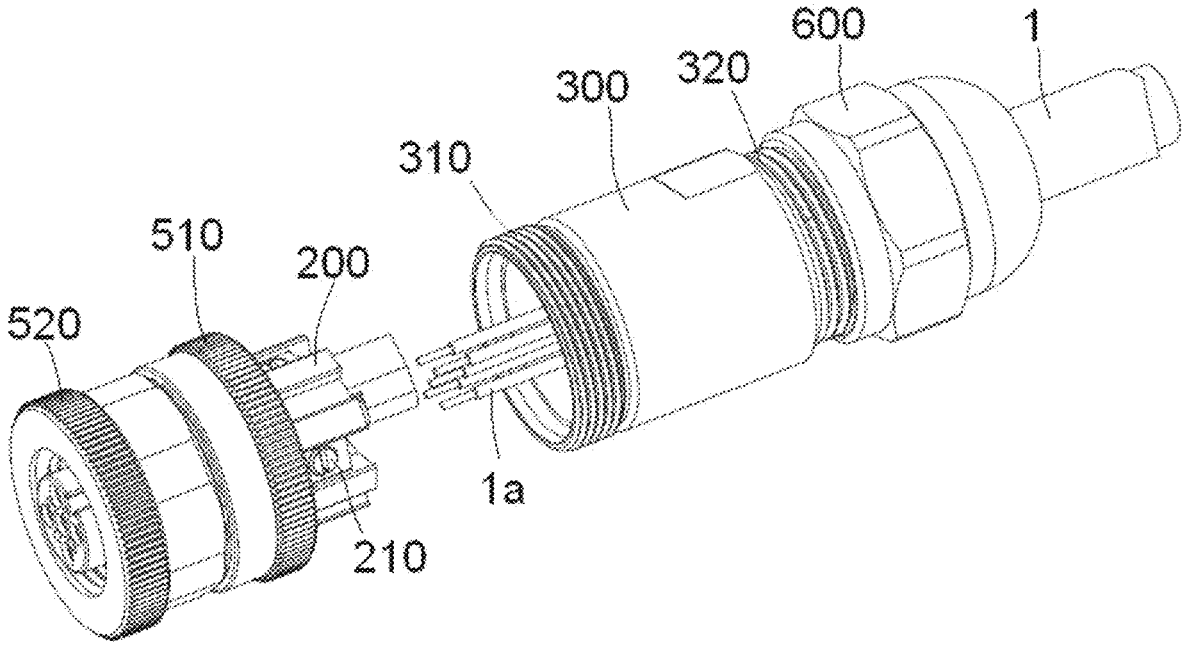
FIG. 6 is a perspective view of screwing the thread sleeve and a nut of the connector onto both ends of the metal housing.

The connector, as shown in FIGS. 1, 2, and 6, comprises a first nut 510 screwed onto the front end 310 of the metal housing 300 and configured to position the insulation body 100 in the metal housing 300. The front end of the insulation body 100 extends out of the front end 310 of the metal housing 300. The connector comprises a second nut 520 mounted on the front end of the insulation body 100; the second nut 520 is adapted to be screwed onto a mating connector (not shown).

The connector further comprises a screw 210, as shown in FIGS. 2 and 6. The screw 210 is screwed into a thread hole formed in an end of the contact 200 and configured to fix a conductor 1*a* of the cable 1 to the end of the contact 200, so as to electrically connect the cable 1 to the contact 200.

A second groove and a third groove extend circumferentially around an outer wall of the insulation body 100, as shown in FIG. 2. A second seal ring 11 is received in the second groove and compressed between the insulation body 100 and the metal housing 300, so as to seal an interface between the insulation body 100 and the metal housing 300. A third seal ring 13 is received in the third groove and compressed between the insulation body 100 and the second nut 520, so as to seal an interface between the insulation body 100 and the second nut 520.

What is claimed is:

1. A connector, comprising:

a metal housing;

an insulation body received in the metal housing;

a contact disposed in the insulation body;

a cable inserted into the metal housing and electrically connected to the contact;

a metal sleeve disposed in the metal housing and electrically contacting the metal housing, a plurality of braided shielding wires of the cable are turned back onto an outer sheath of the cable and the metal sleeve is sleeved on the plurality of braided shielding wires and presses the plurality of braided shielding wires on the outer sheath of the cable;

a plastic tail sleeve sleeved on a rear portion of the metal sleeve and mounted in a rear end of the metal housing, and having a first positioning protrusion extending circumferentially around an inner wall of the plastic tail sleeve;

wherein the metal housing has a second positioning protrusion extending circumferentially around an inner wall of the metal housing; and wherein the metal sleeve is pressed and positioned between the first positioning protrusion and the second positioning protrusion, and the metal sleeve electrically contacts the metal housing.

2. The connector of claim 1, wherein the first positioning protrusion abuts against a rear end of the metal sleeve and the second positioning protrusion abuts against a front end of the metal sleeve, the front end of the metal sleeve electrically contacts the second positioning protrusion of the metal housing.

3. The connector of claim 2, further comprising an elastic seal sleeve adapted to be sleeved on the cable.

4. The connector of claim 3, further comprising a thread sleeve adapted to be screwed onto the rear end of the metal housing.

5. The connector of claim 4, wherein the plastic tail sleeve has a plurality of elastic claws at a rear end of the plastic tail sleeve, the plurality of elastic claws being arranged around the elastic seal sleeve.

6. The connector of claim 5, wherein the thread sleeve is configured to press the plurality of elastic claws on the elastic seal sleeve, pressing the elastic seal sleeve on the cable by the plurality of elastic claws.

7. The connector of claim 6, wherein the thread sleeve has a tapered inner wall surface that is gradually narrowed and adapted to press the plurality of elastic claws on the elastic seal sleeve, pressing the elastic seal sleeve on the cable.

8. The connector of claim 1, wherein the insulation body is received in a front end of the metal housing and the cable is adapted to be inserted into the connector from the rear end of the metal housing.

9. The connector of claim 8, further comprising a first nut screwed onto the front end of the metal housing and configured to position the insulation body in the metal housing.

10. The connector of claim 9, wherein the front end of the insulation body extends out of the front end of the metal housing.

11. The connector of claim 10, further comprising a second nut mounted on the front end of the insulation body and adapted to be screwed onto a mating connector.

12. The connector of claim 1, further comprising a screw screwed into a thread hole formed in an end of the contact and configured to fix a conductor of the cable to the end of the contact, electrically connecting the cable to the contact.

13. The connector of claim 1, wherein the connector is a round connector with a cylindrical shape.

14. A connector, comprising:

a metal housing;

an insulation body received in the metal housing;

a contact disposed in the insulation body;

a cable inserted into the metal housing and electrically connected to the contact;

a metal sleeve disposed in the metal housing and electrically contacting the metal housing, a plurality of braided shielding wires of the cable are turned back onto an outer sheath of the cable and the metal sleeve is sleeved on the plurality of braided shielding wires and presses the plurality of braided shielding wires on the outer sheath of the cable and;

a plastic tail sleeve sleeved on a rear portion of the metal sleeve and mounted in a rear end of the metal housing;

wherein the plastic tail sleeve has a first groove extending circumferentially around an outer wall of a main body of the plastic tail sleeve, a first seal ring is disposed in the first groove and compressed between the plastic tail sleeve and the metal housing to seal an interface between the plastic tail sleeve and the metal housing.

15. The connector of claim 14, wherein the insulation body has a second groove extending circumferentially around an outer wall of the insulation body, a second seal ring is disposed in the second groove and compressed between the insulation body and the metal housing to seal an interface between the insulation body and the metal housing.

16. The connector of claim 15, wherein the insulation body has a third groove extending circumferentially around the outer wall of the insulation body, a third seal ring is disposed in the third groove and compressed between the insulation body and the second nut to seal an interface between the insulation body and the second nut.

17. The connector of claim 14, further comprising a screw screwed into a thread hole formed in an end of the contact and configured to fix a conductor of the cable to the end of the contact, electrically connecting the cable to the contact.

18. The connector of claim 14, further comprising an elastic sleeve adapted to be sleeved on the cable, and a thread sleeve adapted to be screwed onto the rear end of the metal housing, wherein the plastic tail sleeve has a plurality of elastic claws at a rear end of the plastic tail sleeve, the plurality of elastic claws being arranged around the elastic seal sleeve.

19. The connector of claim 18, wherein the thread sleeve is configured to press the plurality of elastic claws on the elastic seal sleeve, pressing the elastic seal sleeve on the cable by the plurality of elastic claws.

20. A connector, comprising:

a metal housing;

an insulation body received in the metal housing;

a contact disposed in the insulation body;

a cable inserted into the metal housing and electrically connected to the contact; and a metal sleeve disposed in the metal housing and electrically contacting the metal housing, a plurality of braided shielding wires of the cable are turned back onto an outer sheath of the cable and the metal sleeve is sleeved on the plurality of braided shielding wires and presses the plurality of braided shielding wires on the outer sheath of the cable;

a plastic tail sleeve sleeved on a rear portion of the metal sleeve and mounted in a rear end of the metal housing, and having a first positioning protrusion extending circumferentially around an inner wall of the plastic tail sleeve;

wherein the metal housing has a second positioning protrusion extending circumferentially around an inner wall of the metal housing;

wherein the metal sleeve is pressed and positioned between the first positioning protrusion and the second positioning protrusion, and the metal sleeve electrically contacts the metal housing; and wherein the plastic tail sleeve has a first groove extending circumferentially around an outer wall of a main body of the plastic tail sleeve, a first seal ring is disposed in the first groove and compressed between the plastic tail sleeve and the metal housing to seal an interface between the plastic tail sleeve and the metal housing.

* * * * *